US005590999A

United States Patent [19]

Murphey

[11] Patent Number: 5,590,999

[45] Date of Patent: Jan. 7, 1997

[54] METHOD AND APPARATUS FOR MAKING SNOW CONES

[76] Inventor: James D. Murphey, 2438 W. Butler, Phoenix, Ariz. 85021

[21] Appl. No.: 390,773

[22] Filed: Feb. 17, 1995

Related U.S. Application Data

[60] Division of Ser. No. 167,401, Dec. 13, 1993, Pat. No. 5,390,711, which is a continuation-in-part of Ser. No. 939, 701, Sep. 2, 1992, abandoned.

[51] Int. Cl.[6] ..... B65B 1/04

[52] U.S. Cl. ..... 414/795.6; 141/372; 414/798.1

[58] Field of Search ..... 141/372; 414/795.6, 414/797.4, 798, 798.1

[56] References Cited

U.S. PATENT DOCUMENTS

| | | | |
|---|---|---|---|
| 3,907,472 | 9/1975 | Lutsey | 425/127 |
| 4,102,365 | 7/1978 | Jordan et al. | 141/372 |
| 4,174,742 | 11/1979 | Murphey | 141/11 |
| 4,688,735 | 8/1987 | Shinji et al. | 414/795.6 |
| 4,718,610 | 1/1988 | Gallaher | 241/37.5 |
| 4,772,171 | 9/1988 | Mayer et al. | 414/797.4 |
| 4,948,011 | 8/1990 | Mueller et al. | 414/795.6 |
| 5,067,308 | 11/1991 | Ward | 414/798.1 |

FOREIGN PATENT DOCUMENTS

| | | | |
|---|---|---|---|
| 2204306 | 11/1988 | United Kingdom | 141/372 |
| 2241695 | 9/1991 | United Kingdom | 414/795.6 |

*Primary Examiner*—Karen B. Merritt
*Assistant Examiner*—Gregory A. Morse
*Attorney, Agent, or Firm*—Parsons & Goltry; Robert A. Parsons; Michael W. Goltry

[57] ABSTRACT

Improvements in a snow cone making machine including a retaining collar which interacts with a cone cup to prevent relative movement with respect to each other; an automatic cone cup dispenser having opposing forceps for extracting cone cups singly from a cup canister; and a scanning activation system for reading a product code on the cone cup to activate the preparation of a snow cone.

15 Claims, 9 Drawing Sheets

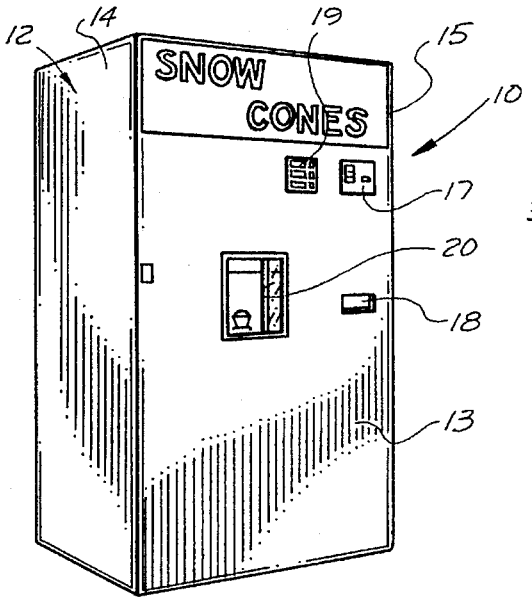
FIG. 1
FIG. 2
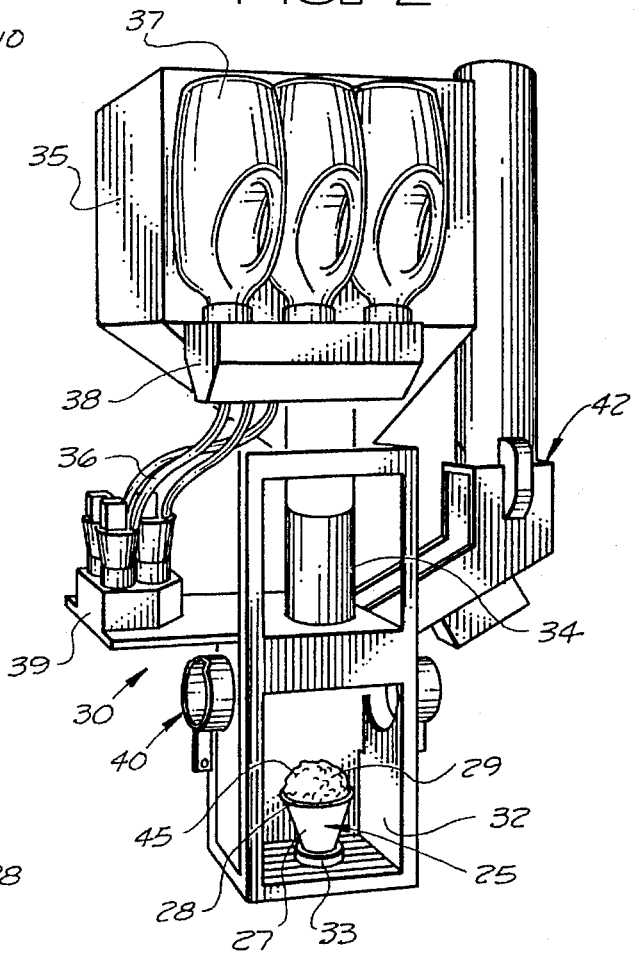
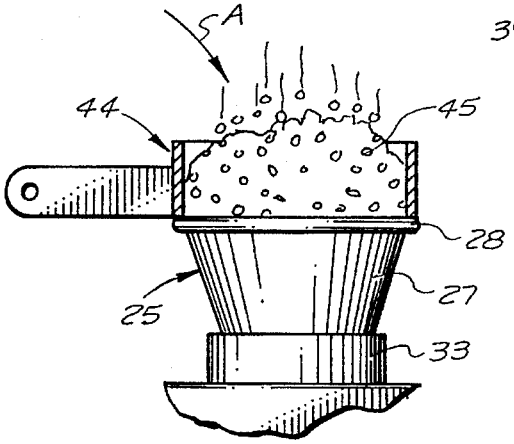
FIG. 3 PRIOR ART
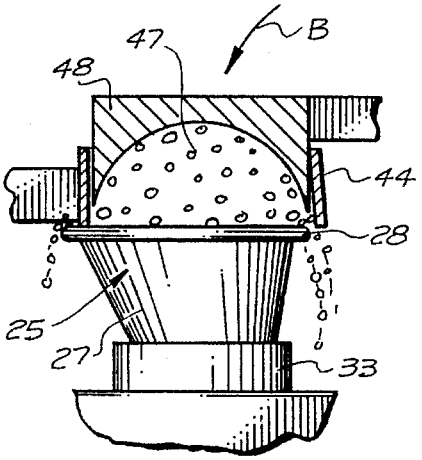
FIG. 4 PRIOR ART
FIG. 5
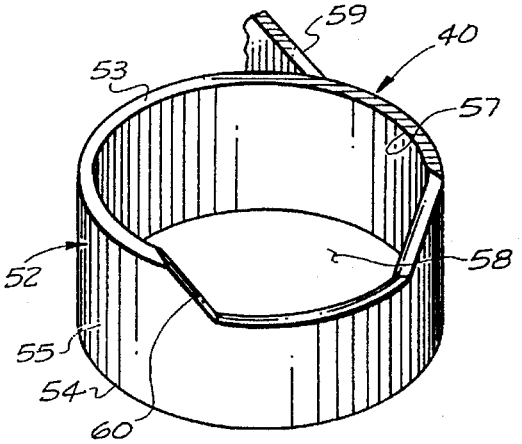

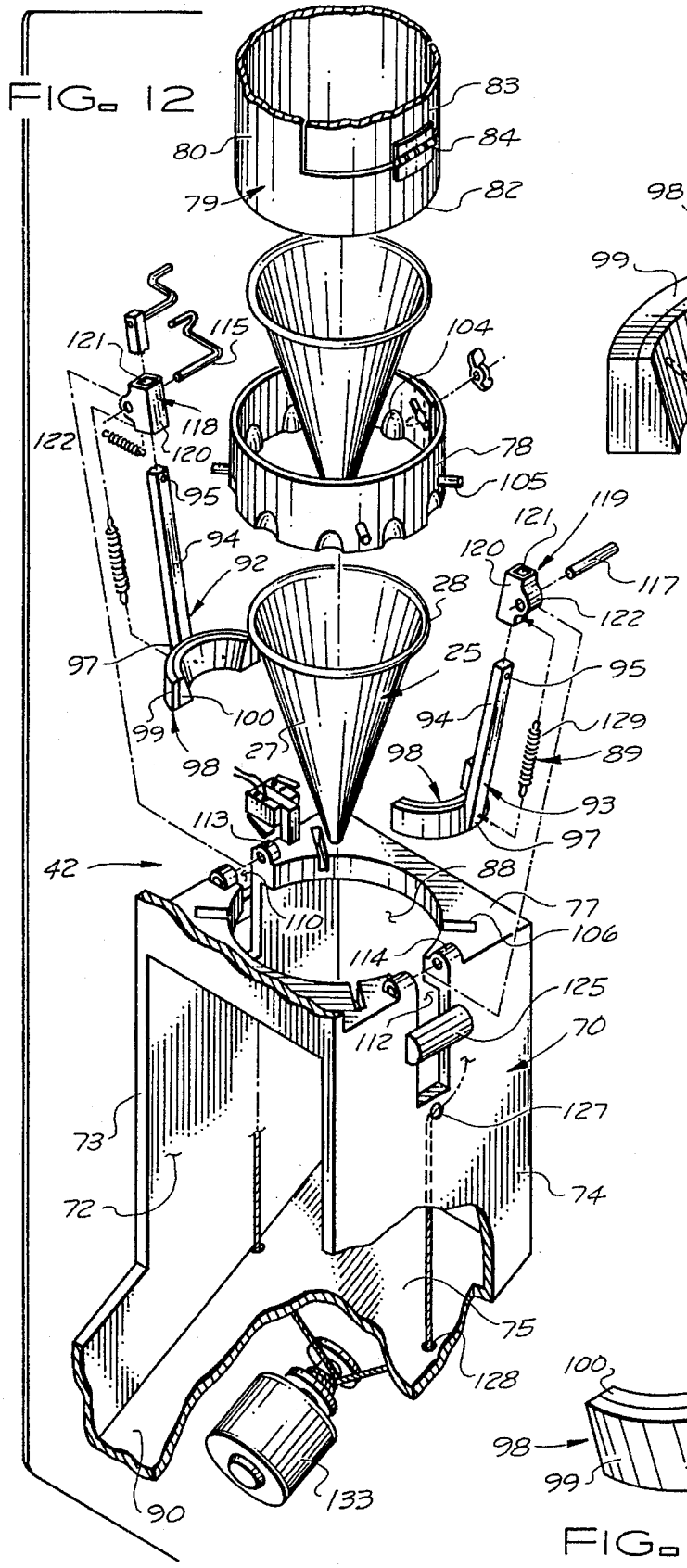
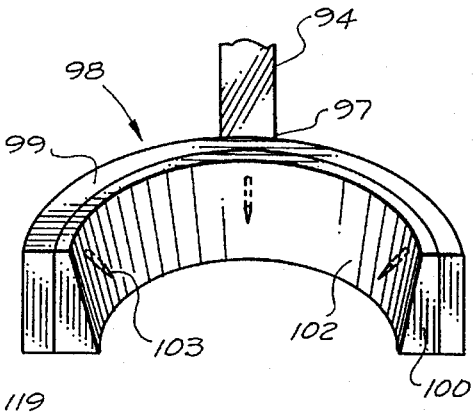
FIG. 13
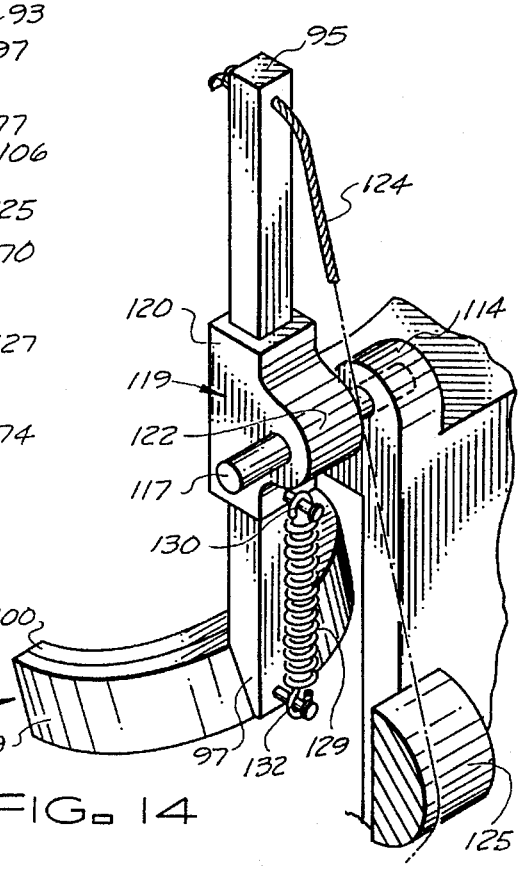
FIG. 14

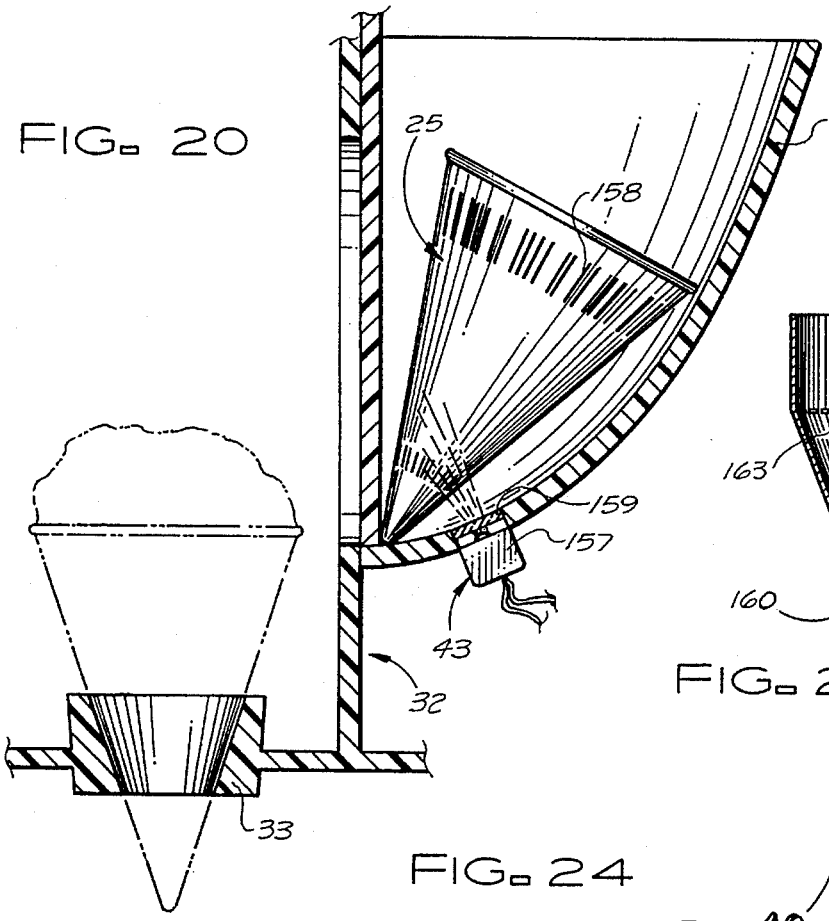
FIG. 20
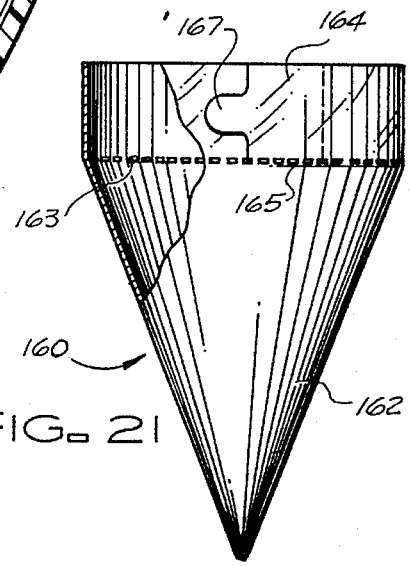
FIG. 21
FIG. 24
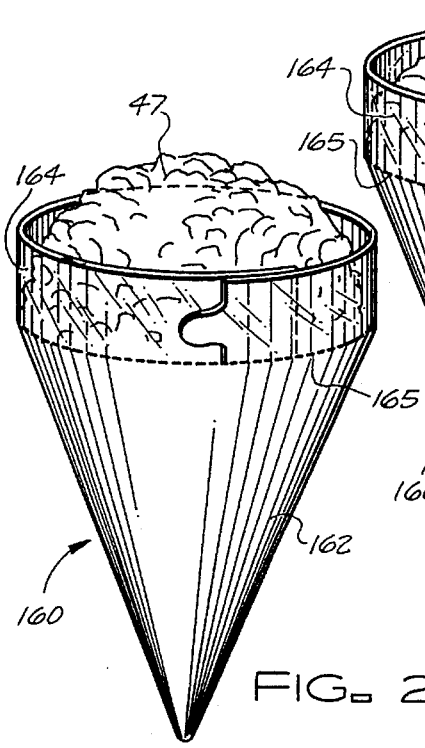
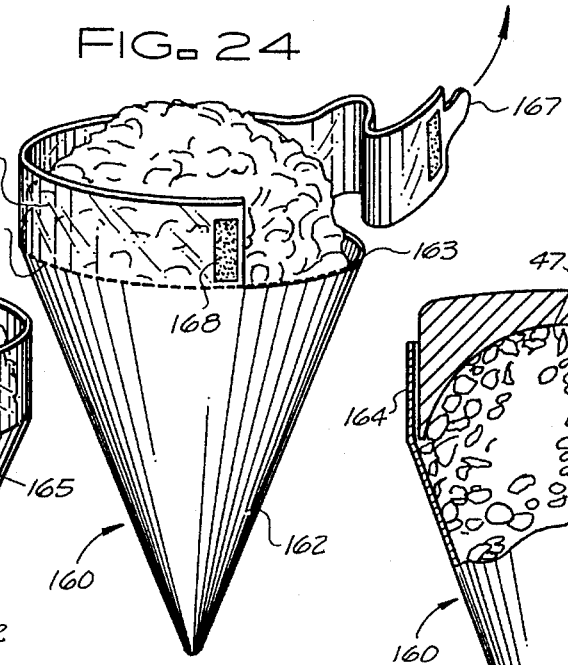
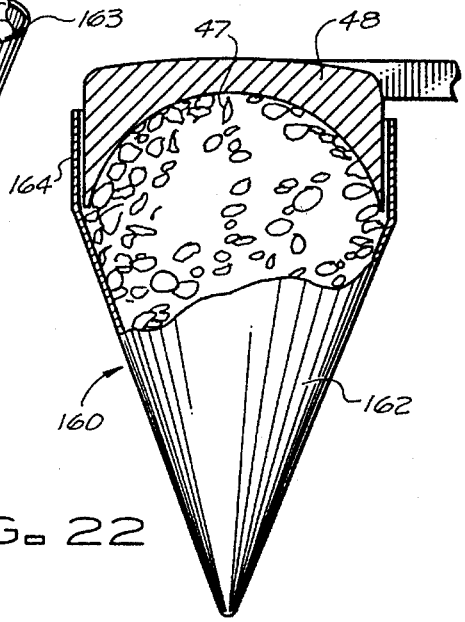
FIG. 23
FIG. 22

METHOD AND APPARATUS FOR MAKING SNOW CONES

This is a divisional of application Ser. No. 08/167,401 filed 13 Dec. 1993, now U.S. Pat. No. 5,390,711 issued on 21 Feb. 1995, which is a continuation in part of application Ser. No. 07/939,701 filed 2 Sep. 1992, now abandoned.

BACKGROUND OF THE INVENTION

1. Field of the Invention

This invention relates to automated dispensing machines.

More particularly, the present invention relates to a method and apparatus for making cold confectionery products.

In a further and more specific aspect the present invention relates to a coin operated machine for automatically making and dispensing snow cones.

2. Prior Art

Snow cones have been made and sold at circuses, carnivals, and other special events and specialty stores, and have been enjoyed by many people for a great many years. However, problems associated with production and distribution have been numerous.

Machines currently being used for making snow cones consists more or less of a grinding machine for making flaked ice, and the other operations such as depositing the ice into a cup and applying the flavored syrup are manually accomplished by an attendant. As is well known, snow cones are made by depositing flaked ice into a cone shaped cup and applying a flavoring syrup thereon. These steps are generally accomplished manually, and depending on the attendant, the environment, and the equipment used, such a manual operation can be very unsanitary.

Many of the problems associated with making snow cones have been overcome by an automated snow cone machine, which produces snow cones in a very sanitary environment. The automated snow cone maker makes well shaped cones and dispenses the syrup evenly over the ice. While the automated snow cone machine makes an attractive snow cone, there is a problem with its ice cap crumbling when consumed. The existing snow cone machine includes a collar which is lowered into contact with the lip of a cone cup. This retains the ice from which the distinctive ice cap is shaped. An ice capping device is lowered to shape the ice cap. While this effectively produces a well shape ice cap, the shaping process causes a slight relative movement between the collar and the cup. This slight movement causes the ice cone to break away from the cup proximate the lip. When the cone is bitten into, the ice cap will crumble.

Another problem associated with most automatic dispensing machines involves fraud and cheating in the vending business. Manipulation and knock downs on the products by operators, route service people and employees is one of the biggest problems of an owner or vending machine company. The company may hold them liable for route inventory or short fall, however the fraud and cheating is very difficult to detect. With regards specifically to snow cone machines, it is simple for the operator to water the snow cone syrup, or to supply their own syrup and cups. Diluting the syrup is very difficult to detect. Therefore, control is very difficult, and cheating can only be detected when taken to an extreme.

All vending machines tend to have problems with fraud and cheating, whether single item vending machines as described above, or multiple item vending machines dispensing snacks or drinks. In most vending machines attempts at preventing cheating and fraud are abandoned, and are simply calculated into operating expenses. Others attempt to identify fraud by product/cash accountability. This is analogous to closing the barn door after the horse has escaped. Product/cash accounting by electronic in machine data collection methods are inadequate, even using hand held scanners and in-house customized or commercial bar coding on items. Such means of product tracking do not furnish sufficient machine control to prevent all the many ways of cheating a machine. Therefore, absolute control is very difficult and cheating can only be detected when taken to an extreme. If the route servicing person is inept or greedy, his/her cheating may be detected. However, there are myriad ways of avoiding detection. A route service person, knowing what an operation owner's product costs, can buy and substitute products at a lower cost and pocket the difference. Dispensed items per machine or per column at point of sale will be the same. The operation owner receives the money expected and does not realize his issued product is being substituted.

The costs involved are generally passed on to the consumer with increases in prices, resulting, many times, in lower consumption.

It would be highly advantageous, therefore, to remedy the foregoing and other deficiencies inherent in the prior art.

Accordingly, it is an object of the present invention to provide improvements in automatic snow cone machines.

Another object of the present invention is to provide a snow cone machine capable of producing satisfactory snow cones.

Another object of the present invention is to provide an improved self-contained vending machine for automatically making and dispensing snow cones.

And another object of the present invention is to provide a snow cone machine which operates under extremely sanitary conditions.

Still another object of the present invention is to provide a snow cone machine which produces substantially consistent snow cones.

Yet another object of the present invention is to provide a snow cone making machine which produces relatively inexpensive snow cones.

Yet still another object of the present invention is to provide a snow cone making machine which will reduce cheating and fraud by the operators.

Yet a further object of the present invention is to provide a policing system for preventing cheating and fraud in vending machines.

Yet still another object of the present invention is to provide a policing system which may be installed on an existing vending machine.

And a further object of the present invention is to provide a policing system and method which will provide substantially complete control over items dispensed from a vending machine.

SUMMARY OF THE INVENTION

Briefly, to achieve the desired objects of the instant invention in accordance with a preferred embodiment thereof, provided is a substantially cylindrical structure having a lower edge which engage the rim of a cone cup during snow cone preparation and prevents relative movement therebetween.

A further embodiment includes an automatic cone cup dispenser having a housing for receiving a cup canister. An extraction mechanism, including opposing forceps which are reciprocally and pivotally coupled to the housing, engages and removes cone cups singly from the cup canister. Cups removed from the cup canister are dropped into a chute which directs the cup to the preparation and dispensing compartment of the snow cone making device.

In accordance with a more specific embodiment, a scanning activation system may also be used on the snow cone vending machine or other single item vending machines to police against misuse. The scanning activation system is preferably a bar code scanner which is coupled to the snow cone making device to scan for a designated bar code printed on the cone cups or other items. However, those skilled in the art will understand that other scanning devices such as laser, radio, or infrared used in combination with product codes such as bar-code, strip code, etc. may be used. The scanning activation system would scan for a bar code upon the initiation of a product delivery sequence. If the proper bar code is not scanned, the product delivery sequence is discontinued. In this manner, the amount of syrup needed can be calculated by the number of cups used. This ensures that the quality of snow cones made remains high since substitute or watered syrup would be indicated. If a cone cup does not have the required bar code, the preparation of the snow cone would be halted.

In a further aspect of the invention, a scanning activation system is employed in a multiple item vending machine. A plurality of items are stored in the vending machine, at least one of which is a terminal item, next to be dispensed. The scanning activation system includes a scanning activation device which scans said terminal item. A product delivery sequence is initiated in response to scanning a proper product code on the terminal item. The product delivery sequence is inhibited when the proper product code is absent.

BRIEF DESCRIPTION OF THE DRAWINGS

The foregoing and further and more specific objects and advantages of the instant invention will become readily apparent to those skilled in the art from the following detailed description of the preferred embodiment thereof taken in conjunction with the drawings in which:

FIG. 1 is a perspective view of the snow cone machine, constructed in accordance with the teachings of the instant invention, as it would appear housed in a cabinet;

FIG. 2 is a perspective view illustrating the snow cone making device as it would appear outside the cabinet;

FIGS. 3 & 4 are elevational views of a prior art apparatus for capping a snow cone, illustrating a prior art collar in cross section;

FIG. 5 is a perspective view illustrating the ice retaining collar, constructed in accordance with the teachings of the invention;

FIG. 12 is an exploded perspective view of the automatic cone cup dispenser;

FIG. 13 is an enlarged perspective view of the gripping forceps of the automatic cone cup dispenser;

FIG. 14 is a perspective view illustrating the right side gripping forceps;

FIG. 20 is a cross sectional side view illustrating a cone cup dropping into the frustrum, and being identified by a product code scanner for the activating process;

FIG. 21 is a side view of a cone cup with removable integral retaining collar; and FIG. 22 is a cross sectional side view illustrating shaping of the ice cap utilizing the integral retaining collar;

FIGS. 23–24 illustrate removal of the integral retaining collar after shaping of the ice cap;

DETAILED DESCRIPTION OF THE PREFERRED EMBODIMENT

Figure 6:
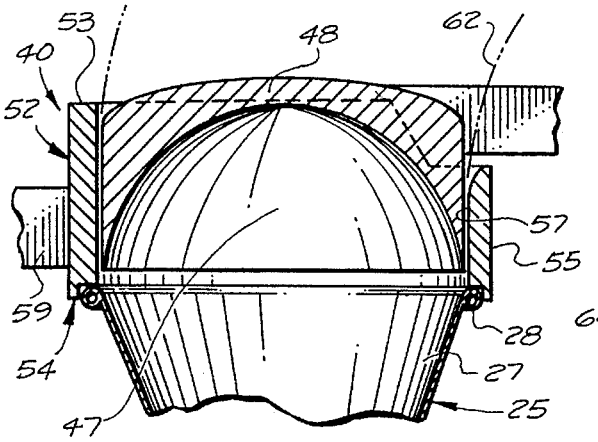
FIG. 6 is a cross sectional view illustrating the retaining collar contacting a cone cup, with a capping device shown extended and shaping the ice cap.

Turning now to the drawings in which like reference numerals indicate corresponding elements throughout the several views, attention is first directed to FIG. 1 which illustrates an automated snow cone making machine generally designated by the reference character 10, incorporating improvements embodying the teachings of the instant invention. In accordance with the conventional prior art, automated snow cone making machine 10 includes a conventional cabinet 12 having a door 13, opposed side walls 14 and 15 along with other structural elements and components common in such cabinets. Snow cone making machine 10 also includes a conventional coin deposit slot 17 and coin return chute 18, both of which are used in a conventional coin receiving mechanism. Door 13 of cabinet 12 is also provided with a flavor selection panel 19 by which a consumer will select the particular flavored syrup to be applied to a snow cone. Door 13 of cabinet 12 is configured so as to expose a product removal door 20.

Referring now to FIG. 2, improvements in a snow cone making device generally designated 30 are illustrated. Snow cone making device 30 includes a preparation and dispensing compartment 32 containing a frustrum 33. Frustrum 33 receives and supports a cone cup 25. Cone cup 25 has a cone shape body 27 with a rolled upper edge 28 defining a mouth 29. Mouth 29 has a specific diameter depending upon the cup size of cone cup 25. The placement of cone cup 25 in frustrum 33 will be discussed in greater detail below. An ice chute mechanism 34 is coupled to the top of preparation and dispensing compartment 32 to guide ice 45 from ice making mechanism 35 into cone cup 25 in compartment 32. Syrup containers 37 are mounted to ice making mechanism 35 by a syrup rack 38. Tubes 36 couple individual containers 37 to a syrup dispensing mechanism 39. The above mentioned elements of snow cone making device 30 are not discussed in detail since they are of conventional construction and well known to those skilled in the art.

Improvements to snow cone making device 30 include an improved retaining collar 40, an improved automatic cone cup dispenser 42 and a scanning activation system 43 (not shown). Each of these improvements in snow cone device 30 will be discussed in greater detail in the following specification. Other than these improvements, snow cone making device 30 operates substantially identical to a conventional device, known to those skilled in the art. Only the improvements will be discussed in detail.

Referring now to FIGS. 3 & 4, a conventional retaining collar 44 is illustrated. Conventional collar 44 pivots down along a path designated by arrow A, over cone cup 25 coming to rest adjacent the upper surface of rolled edge 28. Ice 45 overfills cone cup 25 with the excess ice retained by conventional collar 44. The excess ice is shaped into an ice cap 47, by a capping device 48 which swings down over ice 45 along a path illustrated by arrow B, and into conventional collar 44. While this produces a well-shaped ice cap 47, the thinness of conventional collar 44 resulted in its expansion when capping device 48 shapes ice cap 47, and its subsequent retraction when capping device 48 is removed. This expansion and contraction results in an ice cap 47 which looks satisfactory, but which is not firmly joined on cone cup 25. As can be seen in FIG. 4, this expansion and contraction results in ice being introduced between the conventional collar 44 and the rolled upper edge 28 of cone cup 25. Conventional collar 44 was made of 1/16 inch acrylic, not having substantial rigidity, and with a shape to perform in conjunction with the standard 6 ounce snow cone cup 25. Rolled upper edge 28 of cone cup 25 has a 1/16 inch rim from edge to edge. Furthermore, the undersurface of conventional collar 44 is flat and simply sets upon the upper surface of rolled upper edge 28 of cone cup 25. This results in a slight relative movement between capping device 48 and cone cup 25. The slight relative movement causes ice cap 47 to break loose from the body of the snow cone, resulting in unsatisfactory crumbling when consumed.

Improved retaining collar 40 has a cylindrical structure 52 with an upper edge 53, a lower edge 54, an outer surface 55 and an inner surface 57 defining a bore 58 extending therethrough. Inner surface 57 of collar 40 has a diameter substantially identical to the diameter of the inner edge of rolled upper lip 28. A pivot arm 59 extends outward from outer surface 55 of collar 40 to pivot collar 40 between a raised position and a lower position. In the raised position, collar 40 is retracted from preparation and dispensing compartment 32 as illustrated in FIG. 2. In the lowered position collar 40 engages cone cup 25 were it interfaces with rolled rim 28. An entry notch 60 is formed in retaining collar 40 substantially opposite pivot arm 59 proximate upper edge 53. Notch 60 allows capping device 48 to pivot downward into retaining collar 40 without contacting cylindrical structure 52. The arcing path of capping device 48 can be seen in FIG. 6 as broken lines 62.

In this embodiment, retaining collar 40 is constructed of a clear, rigid material. The material is clear in order to allow the conventional components of snow cone making machine 30 to operate properly in determining the amount of ice flakes required. A rigid material is required to prevent disturbance of ice cap 47 which could result in an unsatisfactory snow cone. To provide strength and rigidity, and to prevent expansion, retaining collar 40 is preferably 1/8 inch thick Plexiglas\.

Figure 7:
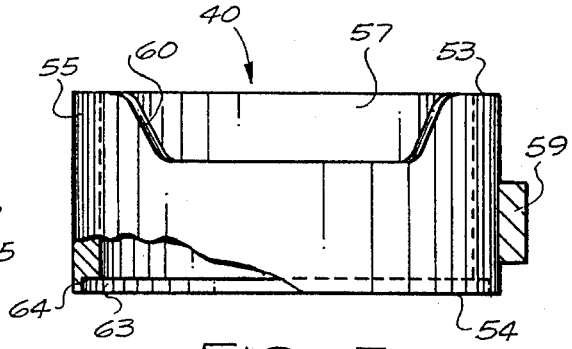
FIG. 7 is an elevational view of the retaining collar.
Figure 8:
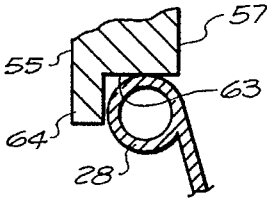
FIG. 8 is an enlarged cross sectional view of the connection between the retaining collar and the rolled rim of the cone cup.

To prevent relative movement between mouth 29 of cone cup 25 and retaining collar 40, an engagement structure is formed on lower edge 54. As can be seen in FIG. 7, the engagement structure is a groove 63 circumscribing lower edge 54 adjacent inner surface 57. An extended portion 64 is adjacent outer surface 55. With further reference to FIG. 8, groove 63 has a diameter substantially identical to the diameter of rolled lip 28. When collar 40 is in engagement with cone cup 25, rolled lip 28 is received by groove 63. Extended portion 64 prevents relative movement between cup 25 and collar 40. If collar 40 is moved slightly, cup 25 moves along with it, preventing relative movement therebetween.

Figure 9:
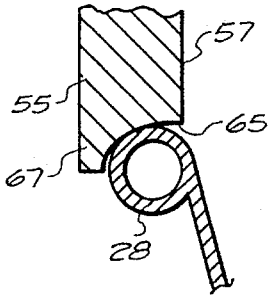
FIG. 9 illustrates an alternate configuration of the retaining collar contacting the rolled rim.
Figure 10:
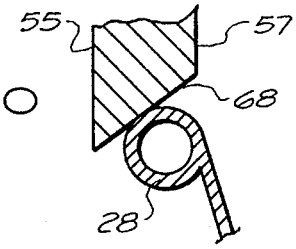
FIG. 10 is an enlarged cross sectional view illustrating a further embodiment of the retaining collar configuration contacting the rolled rim of the coned cup.

Alternate configurations of the engagement structure are illustrated in FIGS. 9 & 10. FIG. 9 illustrates a semi-circular groove 65 formed in lower edge 54 adjacent inner surface 57. An extended portion 67 circumscribes lower edge 54 adjacent outer surface 55, to prevent relative movement between cone cup 25 and retaining collar 40. FIG. 10 illustrates a slanted surface 68, slanting downward from inner surface 57 to outer surface 55. Slanted surface 68 also prevents relative movement between cone cup 25 and retaining collar 40.

Figure 11:
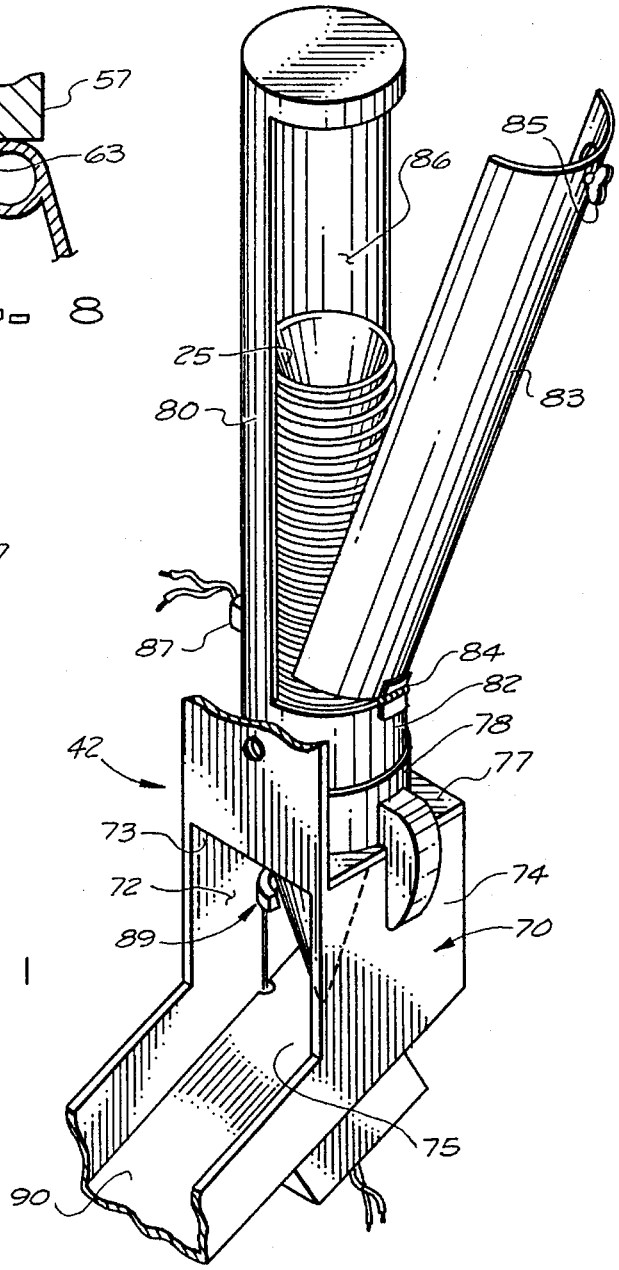
FIG. 11 is a perspective view of the automatic cone cup dispenser.

Turning now to FIG. 11, automatic cone cup dispenser 42 is illustrated. The stiff paper board cups, waxed paper cups, and plastic cups can use available conventional dispensers. This dispenser is for the common commercial, thin collapsible paper, rolled rim, cone cups, used normally for snow cones. Automatic cone cup dispenser 42 consist of a housing 70 having an open front 72, opposing side walls 73 and 74, slanted bottom 75 and a top 77. A canister collar 78 is coupled to top 77 to support a cup canister 79. Cup canister 79 is a tubular body 80 having an opened end 82 receivable by canister collar 78. A side plate 83 is formed in one side of cup canister 79. Side plate 83 is hingedly coupled at one end by a hinge 84 which allows side plate to pivot outward providing an access port 86 to the inside of tubular body 80. A latch 85 is coupled to side plate 83 on the end opposite hinge 84, to latch side plate 83 to tubular body 80. A pivot switch 87 or similar device is coupled to one side of cup canister 79 to determine when cup canister 79 is empty and requires more cone cups 25. An opening 88 in top 77 receives canister collar 78 and provides access for cone cup 25 to enter housing 70 from cup canister 79.

Still referring to FIG. 11, an extraction mechanism 89 is coupled to top 77 of housing 70 to singly extract cone cup 25 from cup canister 79. A chute 90 extends from slanted bottom 75 at open front 72 to guide extracted cone cup 25 into a cone cup hopper 91 at the rear of preparation and dispensing compartment 32 were it is guided into and supported by frustrum 33.

An exploded view of automatic cone cup dispenser 42 is illustrated in FIG. 12, specifically showing extraction mechanism 89. Extraction mechanism 89 consist of opposing forceps 92 and 93, pivotally depending from top 77 of housing 70, one to each side of opening 88. Forceps 92 and 93 each consist of a forceps arm 94 having a first end 95, a second 97 and a gripping member 98 attached to second end 97 of forceps arm 94. With further reference to FIG. 13, gripping member 98 includes a rigid semi-circular frame 99, lined by gripping layer 100 having an inwardly slanting inner surface 102. Pins 103 extend through gripping layer 100, and are very slightly exposed downwardly on inner surface 102. Gripping layer 100 is preferably composed of silicon or other resilient material, having a high coefficient of friction.

Gripping members 98 of forceps 92 and 93 pivot inward to encircle and contact cone cup 25 depending from cone dispenser 42. Gripping members 98 are then moved downward, away from cone cup dispenser 42, withdrawing cone cup 25 from canister collar 78 Canister collar 78 is a split ring, to allow adjustment in diameter to accommodate cone cups 25 of differing diameters. A plurality of dimples 104 extend inward from canister collar 78, forming a friction grip at rolled rim 28 of cone cups 25. This friction grip retains the stack of cone cups 25 in cup canister 79. Canister 80 is also supported by dimples 104. Extensions 105 extending from canister collar 78 fit into corresponding notches 106 formed around opening 88 in top of 77 of housing 70. Extensions 105 and notches 106 provide a coupling between canister collar 78 and housing 70 which may be quickly engaged and disengaged. Gripping members 98 are moved in a downward direction by the extension of forceps arms 94. Upon retraction of forceps arms 94, gripping members 98 pivot outward, releasing cone cup 25 onto slanted bottom 75. The movement of forceps arms 94 will be discussed in greater detail below. The slight exposure of pins 103 enhance the gripping ability of gripping members 98 and insure the extraction of cone cup 25 from canister collar 78. Those skilled in the art will understand that pins 103 extend outward sufficiently to increase the friction against cone cup 25, but will not damage or pierce cone shape body 27 of cone cup 25. It will also be understood that while pins 103 are illustrated, the material used for gripping layer 100 may have a sufficiently high coefficient of friction to disregard pins 103.

Forceps 92 and 93 are mounted on sidewalls 73 and 74 of housing 70. Slots 110 and 112 are formed in sidewalls 73 and 74 respectively, and top 77, and merge with opening 88. A pivot point for each slot 110 and 112 is formed by a bifurcated bracket 113 and 114 extending from top 77 straddling slots 110 and 112 respectively. Forceps 92 and 93 are pivotally coupled to brackets 113 and 114 by fulcrum collars 118 and 119 respectively. Fulcrum collars 118 and 119 are each a generally square tube 120 having a square bore 121 extending vertically therethrough. An attachment member 122 extends horizontally outward from each square tube 120 for engagement with bifurcated brackets 113 and 114. Attachment members 122 are pivotally coupled to bifurcated brackets 113 and 114 by pins 115 and 117 respectively, which extend through bifurcated brackets 113 and 114 and through attachment members 122. Forceps arms 94 of forceps 92 and 93, are slideably received by bores 121 of fulcrum collars 118, 119 respectively.

Referring to FIG. 14, forceps 93 is illustrated, and includes an actuating cord 124 coupled to first end 95 of forceps arm 94, and extending downwardly and outwardly over a guide member 125 extending from side wall 74. Guide member 125 forces cord 124 outward, providing an optimal angle for pivoting forceps 93. Cord 124 continues downward and enters housing 70 through a cord bore 127 formed through sidewall 74 below slot 112. Cord 124 continues downward along sidewall 74 through a guide tube (not shown) and is passed through a second cord bore 128 formed in slanted bottom 75 proximate sidewall 74. To actuate forceps 93, cord 124 is shortened, pivoting forceps 93 and forcing forceps arm 94 downward through fulcrum collar 119. The inward pivoting of gripping member 98 results in contact between gripping layer 100 and cone cup 25. The downward extension of forceps arm 94 extracts cone cup 25 from dispenser 42. A tension spring 129 having a first end 130 coupled to fulcrum collar 119 and a second end 132 coupled to forceps arm 94 proximate first end 95, is expanded by the extension of forceps arm 94. Upon the subsequent lengthening of cord 124, spring 129 retracts, forcing forceps arm 94 upward through fulcrum collar 119 to its original position. The weight of gripping member 98 causes forceps arm 94 to pivot, with gripping member 98 pivoting outward towards side wall 74 releasing cone cup 25. It will be understood by those skilled in the art that the operation of forceps 92 is substantially identical to the before said operation of forceps 93, therefore identical description as to its operation is omitted.

Figure 17:
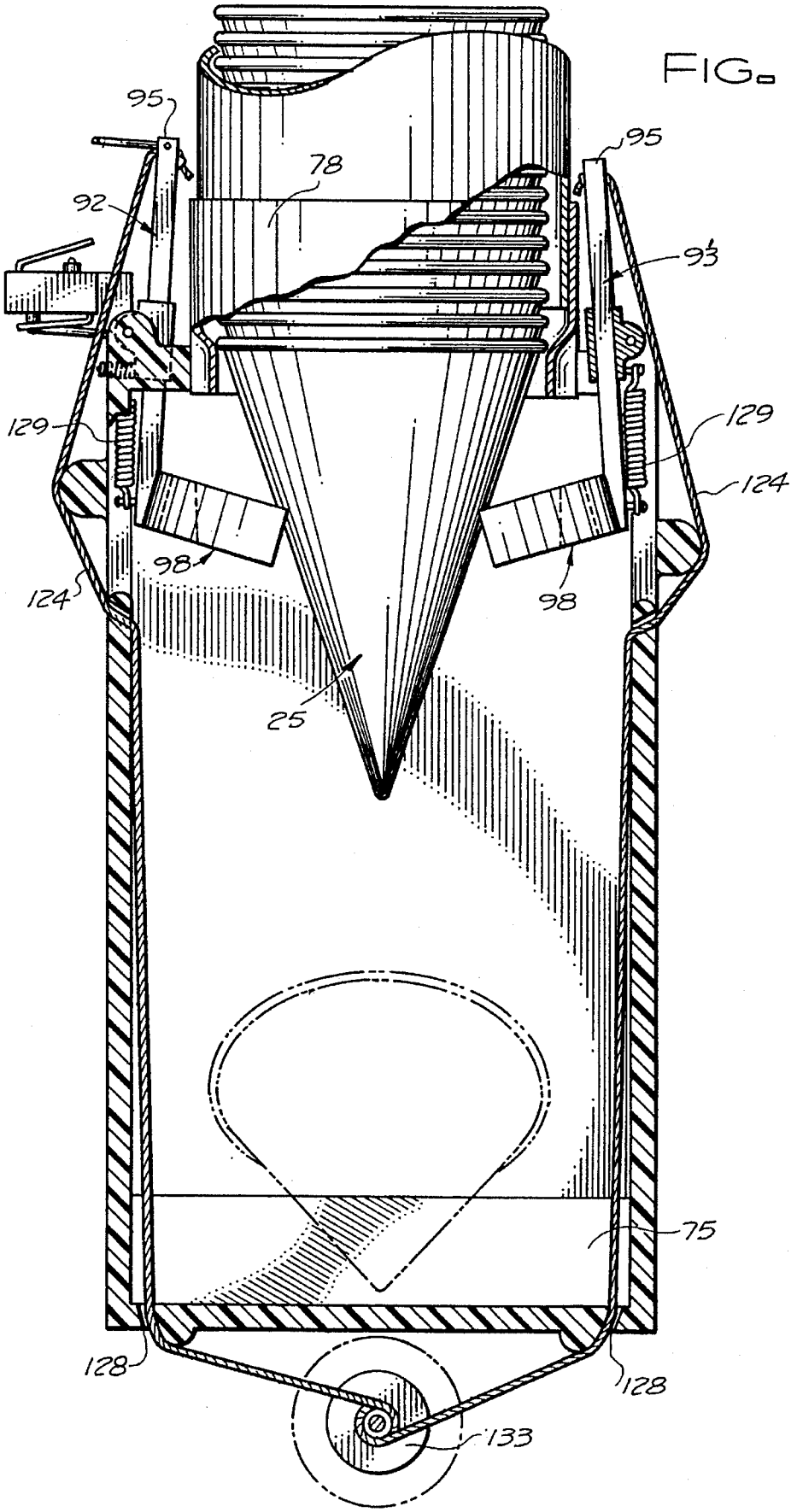
FIG. 17 is a cross sectional side view of the automatic cone cup dispenser.

FIG. 17 illustrates forceps 92 and 93 in the retracted position prepared for removing a cone cup 25 from canister collar 78. In operation cords 124 coupled to forceps 92 and 93 are lengthened and shortened by an actuating device 133, which in this preferred embodiment is a two-way motor which operates in forward and reverse. Actuating device 133 is located below housing 70 to receive cords 124 from second cord bores 128 formed in slanted bottom 75. Upon activation of actuating device 133 in the forward direction, cords 124 coupled to first end 95 of forceps arm 94 pivot gripping member 98 inward against cone cup 25. As actuating device 133 continues to move in the forward direction, shortening cords 124, forceps arms 94 are extended downward through fulcrum collars 118 and 119 extracting cone cup 25 from canister collar 78. Actuating device 133 is then stopped and reversed, resulting in lengthening of cords 124. The weight of gripping members 98 pivots them away from cone cup 25 which, when released, slides down chute 90 to preparation and dispensing compartment 32. Tension spring 129 retracts forceps arms 94 through fulcrum collars 118 and 119 until they reach their original positions.

Figure 15:
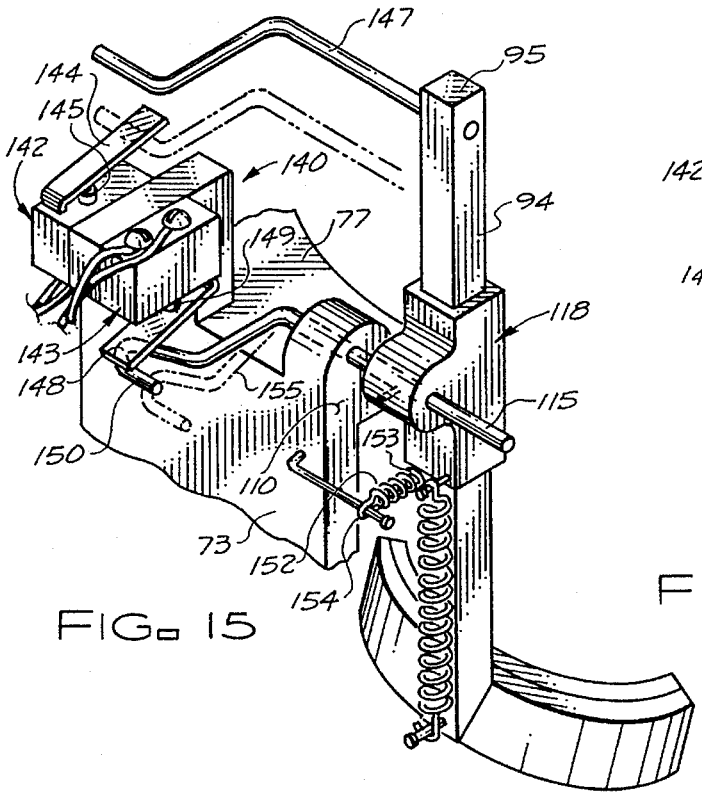
FIG. 15 is a perspective view illustrating the left side gripping forceps.
Figure 16:
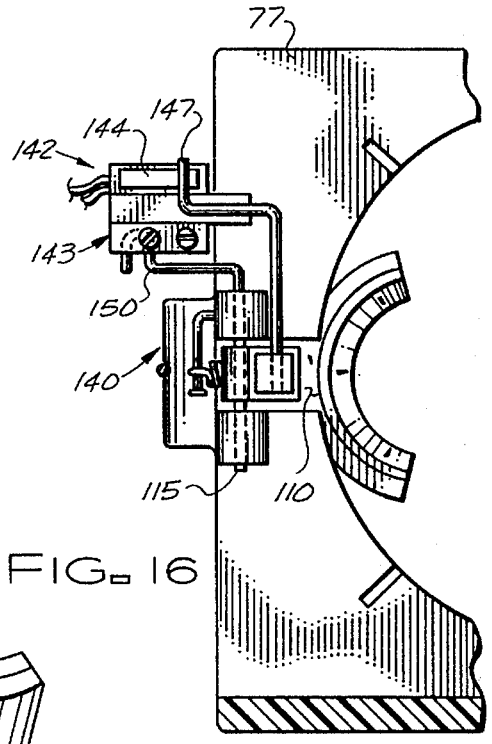
FIG. 16 is a top view of the left side gripping forceps.

The control of actuating device 133 is illustrated in FIG. 15, 16, 18 and 19, and is associated with forceps 92. Referring to FIG. 15, a switch assembly 140 is mounted on top 77 adjacent slot 110. Switch assembly 140 includes a reverse switch 142 and a cut-off switch 143. Reverse switch 142 consists of a contact lever 144 which extends substantially horizontally over a contact 145. A switching pin 147 extends horizontally from first end 95 of forceps arm 94. When actuating device 133 is activated, shortening cord 124, forceps arm 94 is extended downward through fulcrum collar 118. At a point sufficient to extract cone cup 25 from canister collar 78, switching pin 147 contacts and depresses contact lever 144. Contact lever 144 makes contact with contact 145 resulting in the stoppage and reversal of actuating device 133. At this point cone cup 25 is released and forceps arms 94 is retracted through fulcrum collars 118 and 119.

Cut-off switch 143 consist of a contact lever 148 positioned substantially horizontally below a contact 149. A switching extension 150 extends from pin 115 pivoting therewith as fulcrum collar 118 pivots. As cord 124 is relaxed, gripping member 98 causes forceps arm 94 to pivot which in turn causes switching extension 150 to pivot from the position shown by broken line 155 to a position closing cut-off switch 143. To insure the closing of cut-off switch 143, a pivot spring 152 having a first end 153 coupled to a lower portion of fulcrum 118, and a second end 154 coupled to side wall 73 is used which aides in the pivoting of gripping member 98 outward. The closing of cut-off switch 143 by the pivoting of switching extension against contact lever 148, depressing and holding contact 149, results in all power being removed from actuating device 133, stopping the lengthening of cord 124. Forceps 92 and 93 are now in the raised and ready position.

Figure 18:
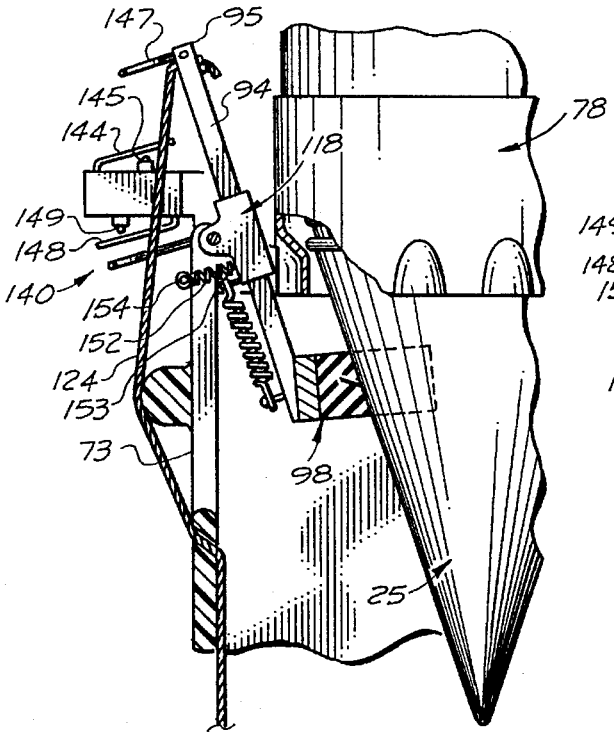
FIGS. 18 & 19 illustrate the operation of the left side gripping forceps.
Figure 19:
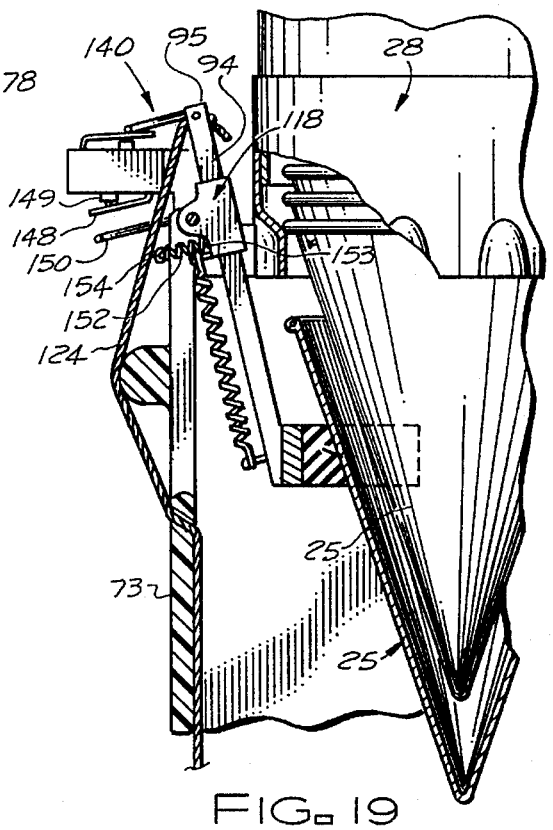

FIG. 18 illustrates the activation of activating device 133 in the forward direction, pivoting gripping member 98 inward against cone cup 25. As actuating device 133 continues to operate in the forward direction, forceps arm 94 is forced downward through fulcrum 118 extracting cone cup 25 from canister collar 78. At a point where cone cup 25 is free from canister collar 78, switching pin 147 depresses contact lever 144 closing reverse switch 142, as illustrated in FIG. 19.

Snow cone making device 30 may also include scanning activation system 43. Scanning activation system 43 could be use in various locations, however in the preferred embodiment it would be positioned proximate the exit of cup hopper 91 as illustrated in FIG. 20. Scanning activation system 43 consists of a product code scanner 157 such as conventional bar code scanner, coupled to an opening 159 in cup hopper 91, which, upon initiation of a product delivery sequence, would permit the preparation of a snow cone to continue. However, the process would only begin if cone cup 25 extracted from automatic cone cup dispenser 42 has a product code, such as bar code 158 printed in a predetermined location thereon. It will be understood that other product codes such as, strip code, color code, etc. could be scanned with various scanners, such as laser, radio, and other conventional scanners. In this preferred embodiment, upon initiation of the product delivery sequence which may include the insertion of coins, the selection of a flavor, and extraction of a cone cup 25 from cone cup dispenser 42, or the product delivery sequence is initiated by the end of a prior sequence, bar code scanner 157 scans cone cup 25. At the end of the product delivery sequence a cone cup 25 is extracted and held in hopper 91 until required. As cone cup 25 drops into hopper 91, bar code scanner 157 identifies bar code 158, and permits the product delivery sequence, the snow cone making process, to continue. This permits a vendor to regulate the products employed in vending machine 10 preventing fraud, theft and cheating. A predetermined quantity of syrup is used with each snow cone cup 25, therefore, if the number of cups used is known, the amount of syrup which should be used is also known. This would prevent watering of the syrup to maintain high quality snow cones and also prevent replacement of syrup with inferior or off brand products.

Those skilled in the art will understand that while scanning activation system 43 is illustrated installed on a snow cone vending machine 10, it could be used in various other applications of the vending business. It would have similar functions for use on vending machines distributing snacks or soft drinks. Bar codes on the snack items or soft drink containers would prevent stocking of the machine with other goods. The scanner would scan the item to be dispensed at all times, and if an item without a bar code is present the product delivery sequence is automatically suspended.

A further embodiment of a cone cup generally designated 160 for use in a snow cone vending machine 10 is illustrated in FIG. 21. Cone cup 160 consist of a cone shape body 162 having an upper edge 163. A retaining collar 164 is formed integrally with cone shape body extending from upper edge 163. Cone cup 160 having retaining collar 164 integral therewith would, if used, allow retaining collar 40 to be omitted from snow cone making device 30. Since retaining collar 164 is integral with cone shape body 162, the problems associated with the original retaining collar, that is relative movement between the retaining collar and the cone cup, would be absent. Retaining collar 164 may be formed integrally with the upper edge 163 of cone shape body 162, with perforations 165 allowing for separation of retaining collar 164 from upper edge 163. For ease in a consumer removing retaining collar 164, a tab 167 is formed on retaining collar 164. When tab 167 is pulled radially outward from cone cup 160, retaining collar 164 is removed along perforations 165 from cone shape body 162. The removal of retaining collar 164 can be seen in FIG. 24. An adhesive 168 is applied to tab 167 to hold it flush with the opposite end of retaining collar 164.

FIG. 22 illustrates the operation of capping device 48 with cone cup 160. As can be seen retaining collar 164 retains ice 45, and allows capping device 48 to pivot downward for shaping ice cap 47. Capping device 48 is then pivoted upward away from cone cup 160 leaving a cone as illustrated in FIG. 23, with retaining collar 164 intact.

Those skilled in the art will understand that while a retaining collar 164 is illustrated being formed integrally with cone cup 160, and having perforations 165 for its easy removal therefrom, a similarly shaped collar of material may be bonded to cone shape body 162 to provide a retaining collar 164 integral with cone cup 160. This could be accomplished with a non-toxic adhesive to removably bond a retaining collar to the upper edge 163 of cone cup 160.

Figure 25:
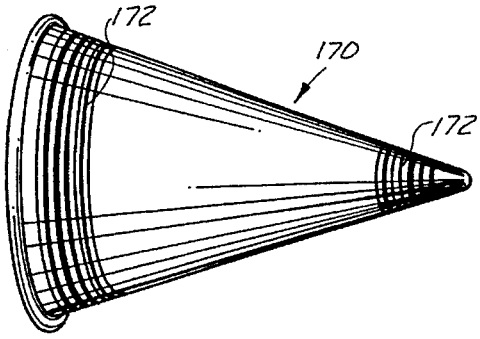
FIG. 25 illustrates coding encircling a cone cup.

Turning now to FIG. 25, an example of a cone cup 170 having a bar code 172 printed thereon is illustrated. In this example, bar code 172 is illustrated encircling the rim and the opposing end of cone cup 170. Cone cup 170 may rotate as it is dispensed, making it extremely difficult to scan if marked in the conventional fashion, with vertical code bars. With bar code 172 encircling cone cup 170 proximate either the rim or the opposite end, rotation of the cup has no effect. In this manner, cone cup 170 may be dispensed at substantially any rotational orientation, with scanning activation device 157 maintaining contact with bar coding 172.

This technique would also be adaptable for any round or cylindrical product such as cans or cups for dispensing soft drinks. As previously described, the code encircles the top or bottom of the product allowing rotation of the product without effect to the scanning process.

Figure 26:
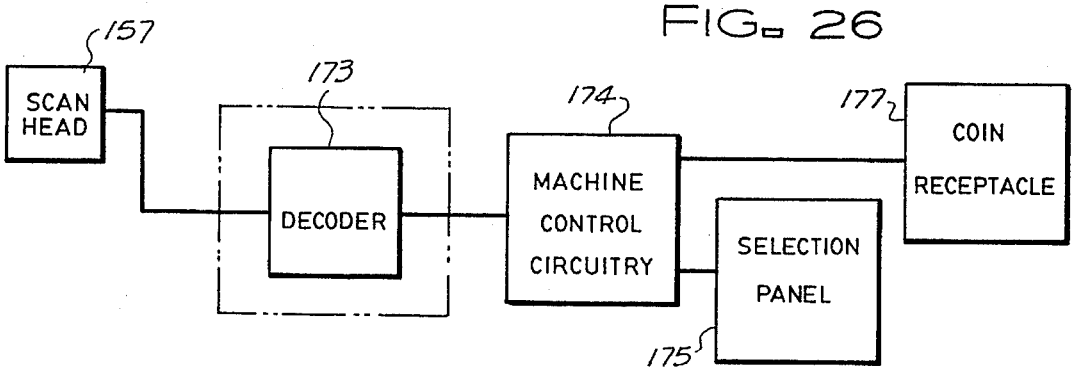
FIG. 26 is a block diagram of a scanning activation system for use on single item vending machines.

FIG. 26 is a simple block diagram illustrating scanning activation system 43. Scanning activation system 43 is intended for use with substantially any single item vending machine, but is specifically shown for use on automated snow cone making machine 10 described previously. Upon activation, a cone cup is dispensed from cone cup dispenser 42, and positioned in frustrum 33. As the cone cup slides down chute 90 to frustrum 33, scanning activation device 157 scans for the proper code, such as that illustrated in FIGS. 20 and 23. Scanning activation device 157 sends the information to a decoder 173 coupled between scanning activation device 157 and machine control circuitry 174 which operates the various functions of snow cone making machine 10, including a selection panel 175 and a coin receptacle 177. Decoder 173 translates the code into a code number and determines if it is correct. If the code translates into the correct code number, the process of making a snow cone proceeds. If the code is incorrect, however, a signal from decoder 173 to machine control circuitry 174 stops the process and initiates various actions to notify customers of an inoperative machine.

As a practical matter, the scanning process begins after a snow cone has been dispensed. The next snow cone making cycle begins before any money is inserted or any selection is made. After a snow cone has been made and dispensed, the cycle continues with the next cone cup being dispensed to hopper 91. As the cup is dropped into hopper 91 from chute 90, it is scanned by scanning activation device 157. If the cup is properly coded, the machine will continue to operate properly. Upon insertion of the proper amount of money into coin receptacle 177, the cone cup will drop into frustrum 33, and the snow cone making process will proceed. If the proper code is not present on the cone cup, various actions will occur. These actions may include illuminating a malfunction light on selection panel 175 and shutting down the coin receptacle 177. In this manner a customer would not loose his money due to an improperly stocked machine.

Figure 27:
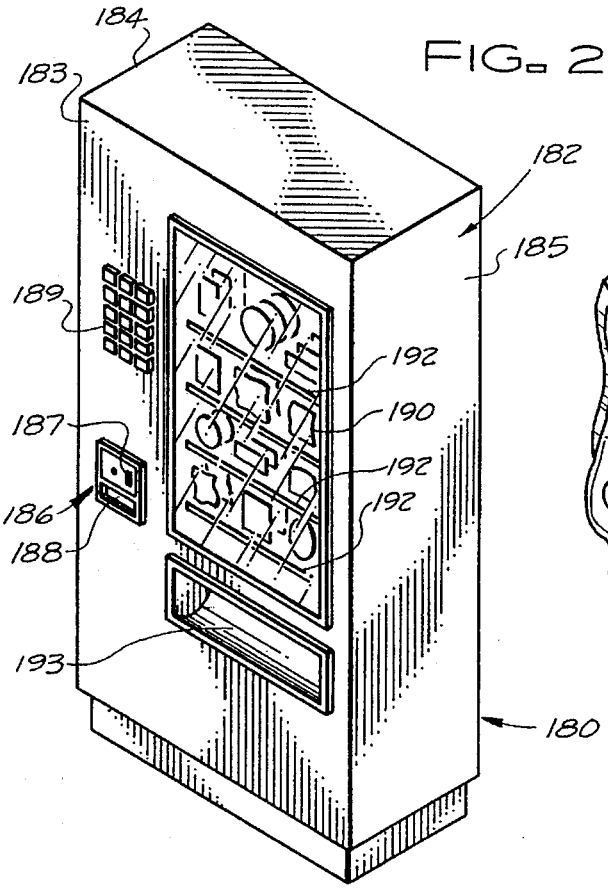
FIG. 27 is a perspective view of a multiple item vending machine.

Another embodiment of the scanning activation system may be employed on multiple item vending machines such as illustrated in FIG. 27. Multiple item vending machine 180 is intended to represent substantially any conventional design, and for purposes of this description includes a conventional cabinet 182 having a door 183, opposed side walls 184 and 185 along with other structural elements and components common in such cabinets. Multiple item vending machine 180 also includes a conventional coin deposit slot 187 and coin return chute 188, both of which are used in a conventional coin receptacle 186. Door 183 of cabinet 182 is also provided with a selection panel 189 by which a consumer selects the particular item desired. The various items carried by the machine are visible through a window 190. A plurality of shelves 192 are mounted within cabinet 182, each shelf 192 supporting a plurality of rows of items visible through window 190. A dispensing slot 193, configured to receive an item selected, is formed in door 183. Slot 193 allows a customer access to the item received therein. Door 183 of cabinet 182 is typically configured to allow access to the items carried within as well as to machine control circuitry 191(not shown).

Figure 28:
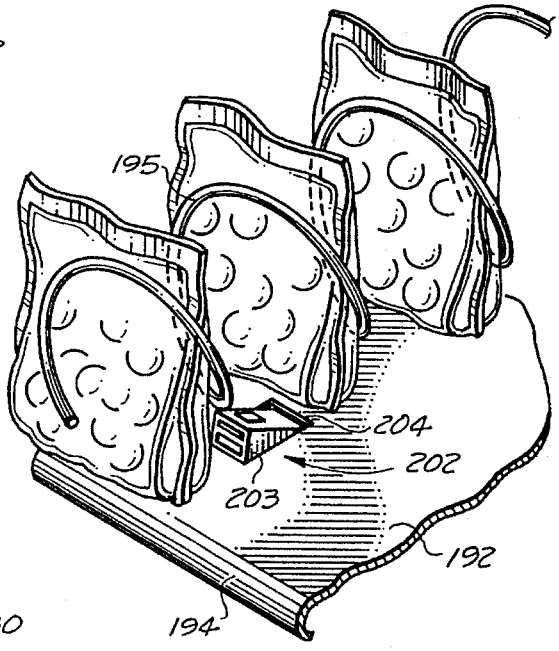
FIG. 28 is an enlarged perspective view of a scanner mounted on a single column in a multiple item vending machine.

With additional reference to FIG. 28, each row of items extends from the rear of shelf 192 to a front edge 194, carried by a helical coil 195. Helical coil 195 advances each item in a row toward front edge 194, with each item eventually reaching a terminal position proximate front edge 194, at which point further advancement dispenses the item. Advancement results from a customer selecting that particular row causing rotation of helical coil 195. The terminal item is dispensed, with the next item advancing to the terminal position. In this embodiment, a scanning activation system 200 is employed which includes a plurality of scanning activation devices 202, one for each row of items.

Each scanning activation device 202 is substantially identical, therefore only one shall be described in the ensuing disclosure. As can be seen in FIG. 28 scanning activation device 202 includes a scan head 203, which extends upward through an aperture 204 formed in shelf 192 between the terminal position in a row and the second position. This allows scanning of the terminal item prior to dispensing. With additional reference to FIG. 29, scan head 203 is enclosed by a housing 205 attached to the underside of shelf 192. Scan head 203 is pivotally mounted to shelf 192, movable between a lowered position and a raised or scanning position. In the scanning position, scanning head 203 is angled upward through shelf 192, positioned to scan a bar code 207 on the back of the terminal item.

Figures 29, 30, 34:
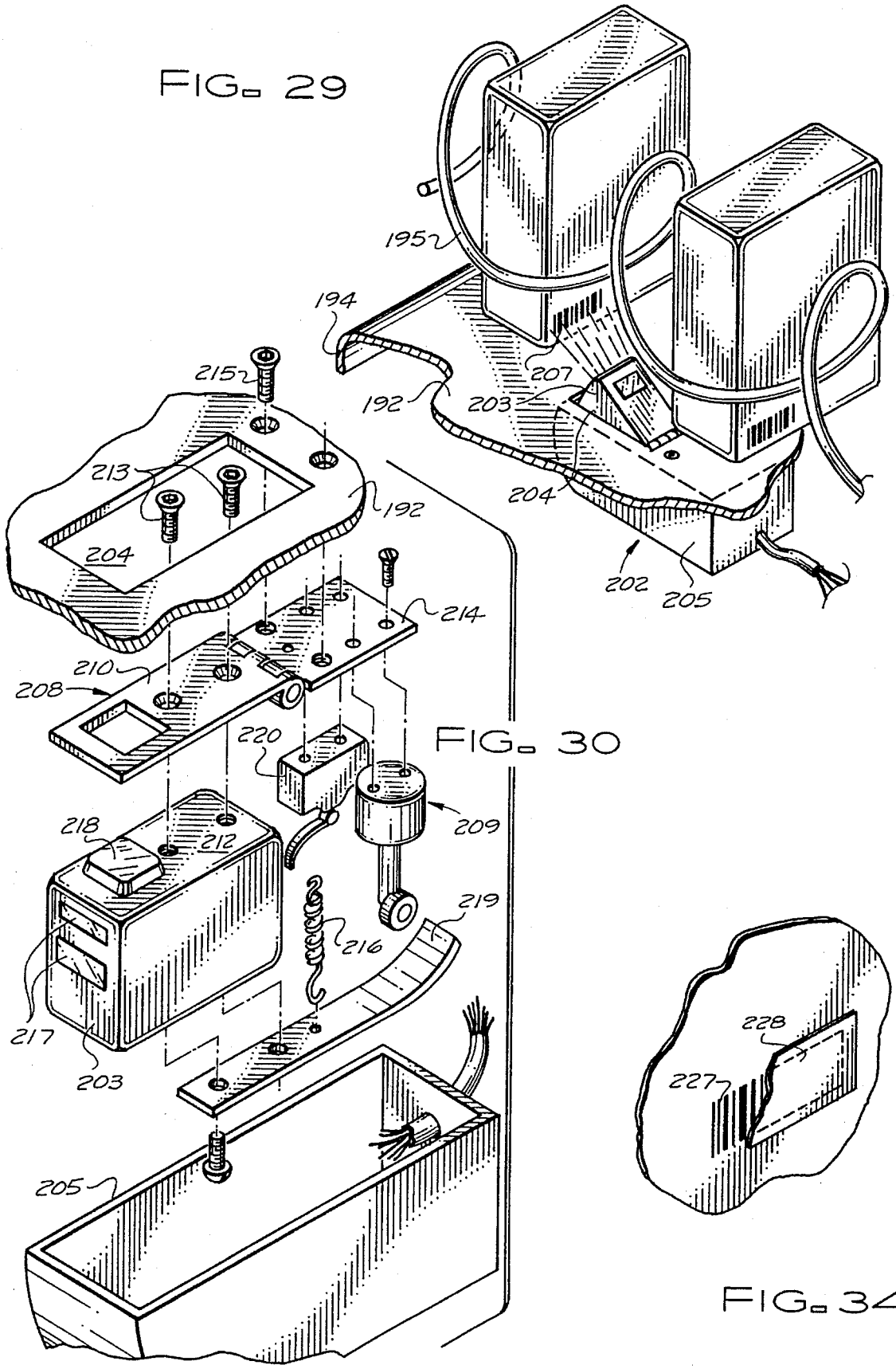
FIG. 29 is an enlarged perspective view of a scanner mounted on a single column, scanning an item to be dispensed.
FIG. 30 is an exploded view of a scanner mounted on a vending machine.
FIG. 34 is a partial perspective view of a concealed bar code for use on dispensed items.

Turning now to FIG. 30, Each scanning activation device 202 includes housing 205 having an open top, scan head 203, a hinge 208, and an actuator 209. Housing 205 is attached to shelf 192 in any conventional manner such as using an adhesive, welding or fastening members, and is configured to enclose scan head 203 to prevent tampering. Scan head 203 is attached to the underside of shelf 192 by hinge 208. Hinge 208 has a first plate 210 coupled to a top surface 212 of scan head 203 by screws 213, and a second plate 214 attached to the underside of shelf 192 by screws 215. Hinge 208 is positioned such that first plate 210 pivots upward, carrying scan head 203 through aperture 204 formed in shelf 192. Scan head 203 protrudes sufficiently above shelf 192 to clear scan openings 217 formed in the forward portion of scan head 203. Scan head 203 may be substantially any scanning apparatus such as photoelectric, optoelectric, laser heat imaging and magnetic devices each of which can perform bar code scanning. The most feasible, developed for merchandise identity and control are infrared and visible laser scanners. In these instances, scan openings 217 include a laser emitting opening and a reflection receiver opening.

Preferably, top surface of scan head 203 also includes an advancement switch 218 which extends through first plate 210 of hinge 208, and whose purpose will be discussed below. Scan head 203 is pivoted upward to the scan position by a lever 219 coupled to its bottom, and operated by actuator 209. Actuator 209 is coupled to second plate 214 of hinge 208 and consists of a solenoid plunger. The plunger acts on lever 219, forcing one end downward, thereby pivoting scan head 203 upward about the juncture between first plate 210 and second plate 214 against the bias of a tension spring 216. A decoder trigger switch 220 is also coupled to second plate 214 of hinge 208 and is switched when scan head 203 is pivoted to the scan position.

Figure 31:
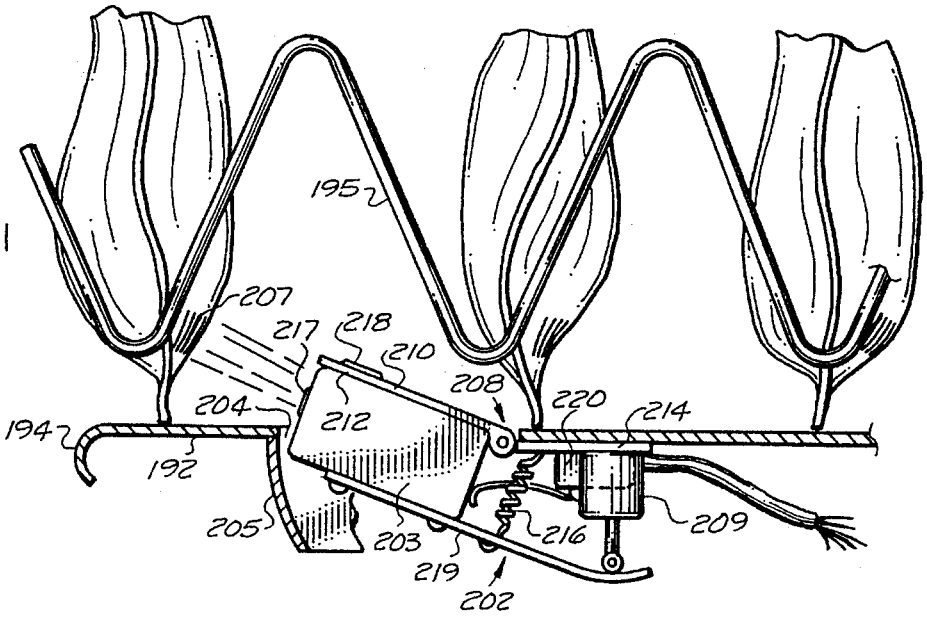
FIG. 31 is a partial side view of the pop-up sensor of FIG. 28 in the scan position.
Figure 32:
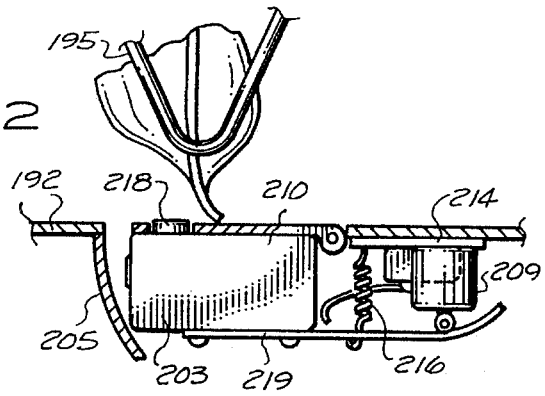
FIG. 32 is a partial side view of the pop-up sensor of FIG. 28 in the lowered position.

After an item is dispensed, and another item has moved to the terminal position, actuator 209 is activated, pushing against lever 219 and pivoting scan head 203 to the scan position as shown in FIG. 31. When scan head 203 is pivoted, it contacts and switches decoder trigger 220. In the scan position, scan head 203 is raised approximately to a 40 degree angle, sufficient to scan coding 207 located on the back of the terminal item. After scanning, actuator 209 retracts, allowing tension spring 216 to move lever 219 back, pivoting scan head 203 to the lowered position, as can be seen in FIG. 32.

In the lowered position, scanning head 203 is flush with shelf 192, permitting advancement of the next item to the terminal position without interference. As the terminal item is dispensed and helical coil 195 advances the next item to the terminal position, that item passes over scan head 203. Advancement switch 218 is switched when an item passes over, the result of which will be described below. Advancement switch may be substantially any switch, such as a mechanical lever mounted proximate each row, to remark when an item is advanced to the terminal position. In this embodiment, advancement switch 218 is a photo diode carried as part of scan head 203. As an item passes over to the terminal position, advancement switch 218 is switched.

Figure 33:
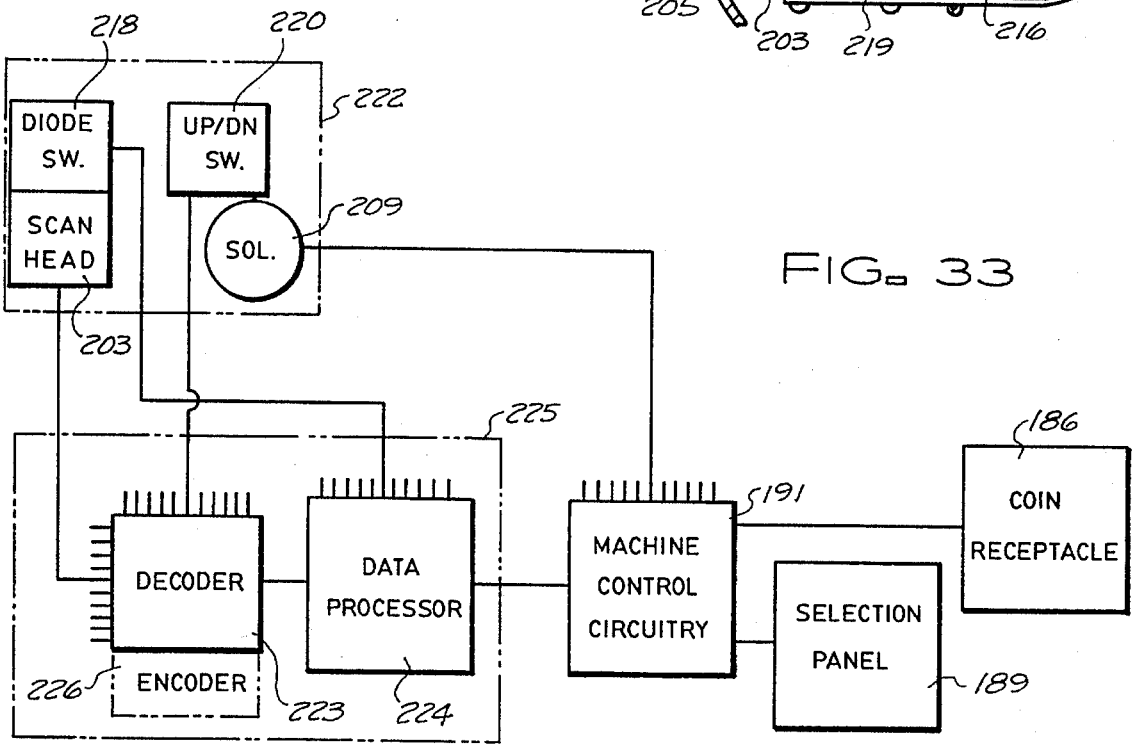
FIG. 33 is a block diagram of a scanning activation system for use on multiple item vending machines.

The complete operation of scanning activation system 200 can be described with reference to FIG. 33. Scanning activation device 202 is illustrated as a broken line 222 enclosing scan head 203, advancement switch 218, actuator 209 and decoder trigger switch 220. A decoder 223, containing a decoder program, and a data processor 224, which may be integral with decoder 223, are mounted as a unit within multiple item vending machine 180 as designated by broken line 225. Decoder 223 and data processor 224 are directly linked to machine control circuitry 191, which in turn is linked to selection panel 189 and coin receptacle 186. A cycle begins after an item has been dispensed from the terminal position of one of the rows. Another item in that row is advanced to the terminal position, passing over advancement switch 218 (FIG. 32). Advancement switch is linked to data processor 224, and must be switched, or data processor 224 will signal machine control circuitry 191 to perform certain actions such as illuminating an empty light for that specific row of items. To prevent trickery, advancement switch 218 Preferably actuates only in a dispensing cycle, on a 3-second time interval. If an item does not move over it within 3-seconds, it will deactivate and remain off, signalling "sold out". Furthermore, if the switch is masked off, it will remain off, signalling "sold out".

If an item passes over advancement switch 218, the cycle will continue, machine control circuitry 191 will activate actuator 209 which pivots scan head 203 to the scan position (FIG. 31). As scan head 203 pivots upward, it contacts and switches decoder trigger switch 220 turning decoder 223 on. Decoder 223 enters read mode and operates scan head 203 scanning bar code 207 on the back of the terminal item (FIG. 31), and receives the information. Decoder 223 translates the bar code into a code number processed by data processor 224 to determine if it is a correct code number. If the bar code translates into the correct code number, the cycle proceeds. If the bar code is incorrect, however, a signal from data processor 224 to machine control circuitry 191 stops the cycle and initiates various actions to notify customers of an inoperative machine.

In scanning activation system 200, the code number is non-repeatable. What this means is that each item in an individual machine 180 must have an individual code number encoded on its back. If the code number has already been translated by decoder 223, data processor 224 will not recognize that code number a second time. If an identical code number is used, a signal from data processor 224 to machine control circuitry 191 stops the cycle and initiates various actions to notify customers of an inoperative machine. In this manner counterfeiting of the bar code is unlikely, since a potential cheater cannot determine which code number has been used and deleted from data processor 224.

When a correct code number has been translated from the bar code, machine 180 will continue operating as usual. A customer inserts money, makes a selection and an item is dispensed, beginning a new cycle. If, however, an incorrect code is translated, data processor 224 signals machine control circuitry 191 to provide indicators of a problem, such as illuminating a malfunction light for that specific row and preventing dispensing of items therefrom, and/or cutting power to coin receptacle 186.

Substantially any system of number coding may be employed to provide a non-repeatable sequence, which is then bar coded for application to the back of an item. The bar coding used may also be substantially any conventional or custom codabar, examples of which include Code 39, Code 11, interleaved 2 of 5, meaning 2 bars 5 spaces, Code 128, Code AN, Code EAN, DES Encrypto (algorithmic logic), and custom codabar. If custom non-repeatable coding is used, an encoder 226 may be required to change the number code to a system decoder 223 can handle. Encoder 226 would actually be a conversion program within decoder 223.

To aid in preventing cheating and fraud, further steps may be taken. The decoding program within decoder 223 may be algorithmic, in this instance meaning an algebraic formula must be translated into a digital form to obtain a logic key. The decoder read-mode actuates on the logic key. Thus, without knowing the formula in the program, the logic key which actuates the read-mode cannot be determined. If a potential cheater does not know the algorithm, and/or logic key, he/she can not attempt to duplicate the bar code or code numbers.

Another feature which may be employed is a voltage regulating device (not shown) coupled to machine control circuitry 191. The voltage regulator device induces an oversurge of electricity if vending machine 180 is plugged into a power device without scanning activation system 200 in place. Furthermore, tampering with housings 205 is prevented by formation of a grounding circuit through housings 205. If housings 205 are tampered with, the circuit is broken and voltage is drawn from the high voltage power source activating the voltage regulator device, thereby producing oversurge, and destroying machine control circuitry 191.

A further security measure is the use of a non-visible bar code. This makes counterfeiting extremely difficult, and enhances the effectiveness of the above mentioned algorithm. Non-visible bar codes can be achieved in a number of ways, including providing a mask 228 which may be used to conceal the bar code. Referring to FIG. 34, bars 227 of the bar code are generally black, with a mask 228 of a similar material of red opaque of darkened hue. An individual will only see a strip or patch of color, usually appearing as black, but is actually red, or if a visible laser is used, may be any color. In any case, this and many other masking techniques are conventional technology and well known to those skilled in the art.

Other techniques for providing non-visible bar codes include using phosphorus solutions to print bar codes. The solution can be any phosphorus, colored, artificially colored or colorless, mixed in a solution of dehydrogenated alcohol, aromatic ethers, ethanol, methanol, chlorates and chlorides, or atom refracting gasses such as neon. The solutions dry quickly on air contact, and are partially absorbed into the paper they are printed on. They leave non-visible phosphorus marks (the code bars), visible only under certain lights such as ultraviolet and infrared which would be used by a scan head.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. An improved device comprising a snow cone making machine for making snow cones in cone shaped cups, wherein said improvement comprises a retaining collar moveable into engagement with a cone cup in a preparation compartment of the snow cone making machine, the retaining collar having a substantially cylindrical structure with an upper edge and a lower edge, said lower edge configured to interact with said cone cup so as to substantially eliminate relative movement between said retaining collar and said cone cup.

2. An improved snow cone machine as claimed in claim 1 for use with said cone cup having a rim, wherein said lower edge of said retaining collar includes an engagement structure which engages said rim of said cone cup.

3. An improved snow cone machine as claimed in claim 2 further comprising a cone cup dispenser for automatically dispensing cone cups having an open end and a cone body, said cone cup dispenser including:

a) a housing having an opening, coupled adjacent the preparation compartment;

b) a cup canister coupled to said housing at said opening for holding a plurality of said cone cups in a stack with said open ends facing away from said opening of said housing; and c) an extraction mechanism coupled to said housing for removing said cone cups singly from said cup canister.

4. An improved snow cone machine as claimed in claim 3 wherein said cup canister comprises:

a) a canister collar for frictionally retaining said cone cups so as to allow the cone body of at least the outermost cone cup to extend partially there past, coupled to said housing around the periphery of said opening with said at least the outermost cone body extending partially thereinto; and b) a tubular body having an open end and an access opening, said open end coupled to said canister collar.

5. An improved snow cone machine as claimed in claim 4 wherein said extraction mechanism of said cone cup dispenser comprises:

a) a first and second fulcrum collar pivotally coupled to said housing on opposing sides of said opening;

b) a first and second forceps, slideably received in said first and second fulcrum collars respectively, for pivotal and reciprocating movement between a retracted and an extended position relative said housing;

c) biasing means for biasing said first and second forceps into said retracted position;

d) actuating means for moving said first and second forceps from said retracted position to said extended position; and e) control means for regulating said actuating means.

6. An improved snow cone machine as claimed in claim 5 wherein said first and second forceps each include:

a) a forceps arm slideably carried by said fulcrum collars, having a first end and a second end; and b) a gripping member coupled to said second end of said forceps arm for engaging said cone body of said cone cup depending from said canister collar.

7. An improved snow cone machine as claimed in claim 6 wherein said gripping member includes:

a) a frame configured to engage said cone body; and b) a gripping layer lining said frame to provide a frictional grip against said cone body.

8. An improved snow cone machine as claimed in claim 7 wherein said gripping member further includes pins extending through said gripping layer, with points partially emerging therefrom to interact with said cone body of said cone cup.

9. An improved snow cone machine as claimed in claim 5 wherein said control means includes:

a) a reverse switch for stopping and reversing said motor; and b) cut-off means for removing power from said motor.

10. An improved snow cone machine as claimed in claim 9 wherein said reverse switch includes a contact and a contact lever, closed by a switching pin extending from said first end of said forceps arm of said first forceps in the extended position.

11. An improved snow cone machine as claimed in claim 9 wherein said cut-off means is coupled to said housing proximate said first forceps, and includes a contact and a contact lever closed by a contact pin extending from said fulcrum collar of said first forceps in its outwardly pivoted position.

12. An improved snow cone machine as claimed in claim 5 wherein said biasing means for each of said first and second forceps includes a tension spring having a first end coupled to said housing and a second end coupled proximate said second end of said forceps arm.

13. An improved snow cone machine as claimed in claim 5 wherein said actuator means includes:

a) a bidirectional motor; and b) a cord coupled between said motor and said first end of said forceps arm of each of said first and second forceps.

14. An improved snow cone machine as claimed in claim 4 wherein said cup canister further includes:

a) a side plate hingedly coupled to said tubular body for closing said access opening; and b) a sensing means for sensing when said cup canister is empty.

15. An improved snow cone machine as claimed in claim 2 wherein said engagement structure of said retaining collar is a groove formed in said lower edge for receiving said rim of said cone cup.

* * * * *